United States Patent [19]

Knox, deceased

[11] 4,393,630

[45] Jul. 19, 1983

[54] ACTUATION MEANS FOR THE RACKING PLATFORM OF A MAST

[75] Inventor: Arnold W. Knox, deceased, late of Tulsa, Okla., by Ester Knox, executrix

[73] Assignee: Crane Carrier Corporation, Tulsa, Okla.

[21] Appl. No.: 243,049

[22] Filed: Mar. 12, 1981

[51] Int. Cl.[3] ..... B66C 23/04; B66C 23/62

[52] U.S. Cl. ..... 52/121; 52/115; 175/85; 182/141; 52/118; 52/1

[58] Field of Search ..... 175/85; 52/115, 118, 52/121, 1; 182/141; 212/267, 269

[56] References Cited

U.S. PATENT DOCUMENTS

| | | | |
|---|---|---|---|
| 710,686 | 10/1902 | Harris | 182/141 |
| 1,924,751 | 8/1933 | Porter | 182/141 |
| 2,336,432 | 12/1943 | Wilson | 182/63 |
| 2,617,500 | 11/1952 | Cardwell et al. | 52/115 |
| 2,703,634 | 3/1955 | Lee | 52/115 |
| 2,804,948 | 9/1957 | Woolslayer et al. | 52/118 |
| 2,829,741 | 4/1958 | Selberg et al. | 52/121 |
| 2,904,949 | 9/1959 | Woolslayer et al. | 56/209 |
| 2,922,501 | 1/1960 | Wilson | 52/118 |
| 2,923,381 | 2/1960 | Wilkinson et al. | 52/115 |
| 2,993,570 | 7/1961 | Bender | 52/118 |
| 3,101,816 | 8/1963 | Fox | 52/118 |
| 3,178,048 | 4/1965 | Bergman et al. | 52/115 |
| 3,738,075 | 5/1973 | Nansel | 52/115 |
| 3,802,137 | 4/1974 | Armstrong | 52/118 |
| 3,874,136 | 4/1975 | Michel | 52/115 |
| 3,942,593 | 3/1976 | Reeve, Jr. et al. | 173/23 |
| 4,021,978 | 5/1977 | Busse et al. | 52/118 |
| 4,134,237 | 1/1979 | Armstrong | 52/118 |
| 4,269,395 | 5/1981 | Newman et al. | 52/115 |

*Primary Examiner*—Alfred C. Perham
*Assistant Examiner*—David J. Thomas
*Attorney, Agent, or Firm*—Head, Johnson & Stevenson

[57] ABSTRACT

In combination with a telescoping well mast structure having a fixed lower structure and a traveling upper structure, a device to time and actuate the extension and retraction of a racking platform pivotally attached to the upper structure. The device comprises at least one pulley secured within the upper derrick structure adjacent the crown and at least one lower pulley secured within the upper structure adjacent the lower end thereof. At least one cable extends from the platform around the upper pulley, the lower pulley and to a wheeled trolley adapted to travel along a portion of the lower structure. When the upper structure is extended the wheeled trolley is propelled along the lower structure by a pushing member on the upper structure until received into a catch housing on the upper portion of the lower structure. Once the wheeled trolley is restrained by the housing continued extension of the upper structure allows for the racking platform to extend by means of gravity. Retraction of the platform is accomplished by reversing the steps outlined above.

16 Claims, 13 Drawing Figures

ACTUATION MEANS FOR THE RACKING PLATFORM OF A MAST

BACKGROUND OF THE INVENTION

1. Field of the Invention

The present invention relates to a device to time and actuate the extension and retraction of a racking platform for a well mast and, more particularly, to such a device which operates automatically upon the extension of the derrick.

2. Description of the Prior Art

On most well masts there is a platform which extends outward from an upper portion thereof and is used to hold or rack strings of drill tubing during the drilling operation or during well servicing. The racking platform may be fixed to the mast or may be pivotally connected for retraction while the rig and mast are moved. Certain forms of rigs are adapted to be attached directly to a large vehicle and are normally used to drill or service moderate depth wells. With these mobile rigs there is a need to keep the height, width and weight to certain maximum limits so that the mobile drilling rig may operate legally upon the roadway. So there is a need to retract the racking platform for movement of the rig and extend the platform at the time of set up.

The mast structure may be carried on the truck horizontally and either mechanically or hydraulically raised. These mast structures usually are segmented or telescoping with the upper portions telescoping upwards from a fixed lower structure. Various devices have been used to extend the racking platform in the past with mechanical or hydraulic power being used most often, however these forms of extension require separate power transmission or hydraulic lines to actuate the racking platform which increases weight, cost and maintenance requirements of the structure. Pulley cable systems have been used to extend and retract the racking platform which require a separate power source to actuate the platform provided by a separate motor or power take-off from the main electrical or hydraulic generator of the drilling rig.

Certain cable and pulley systems have been used which are actuated by the telescoping action of the mast sections. However these prior art systems have not provided flexibility in allowing for any length of mast and the extension of the platform could not be timed to extend after the telescoping action of the mast was sufficient to clear any obstacles, such as an oil well pumping unit.

SUMMARY OF THE INVENTION

It is a primary object of this invention to provide a device to time and actuate the extension and retraction of a racking platform for a well mast.

Another object of the present invention is to provide a racking platform which extends automatically with the telescoping of the mast structure.

Another object of the present invention is to provide a racking platform which does not extend until the uppermost mast structure extends.

Another object of the present invention is to provide a device to time and actuate the extension and retraction of a racking platform without the requirement of a separate power source or power take-off.

Another object of the present invention is to provide a device to time and actuate the extension and retraction of a racking platform which is lightweight, simple and requires little or no maintenance.

Still other advantages and objects of the present invention will become apparent by the reading of the description of the invention.

The present invention is adapted for use on a mobile drilling or well service rig which has a telescoping mast structure having a fixed lower structure and a traveling upper structure. The device to time and actuate the extension and retraction of the racking platform is comprised of at least one upper pulley secured within the upper structure adjacent the crown of the mast and at least one lower pulley secured within the upper structure adjacent the lower end thereof. A wheeled trolley is adpated to move along the lower structure and has a cable pivotally connected thereto which extends downward around the lower pulley, around the upper pulley and is attached to the platform. When the derrick structure is raised and the traveling upper structure begins to extend a pushing member on the upper structure propels the wheeled trolley along the lower structure until the wheeled trolley is received into and restrained by a catch housing on the top end of the lower structure. As the upper structure continues to extend beyond the catch housing, the cable tension is released and the racking platform is allowed to extend by way of gravity. When the mast is lowered the racking platform is raised. As the upper structure is lowered the increased tension on the cable retracts the racking platform into the upright or stored position. As the upper structure continues to be lowered within the lower structure, the downward drawing of the cable withdraws the wheeled trolley from the catch housing and pulls the wheeled trolley against the pushing member.

DETAILED DESCRIPTION OF THE PREFERRED EMBODIMENTS

Before explaining the present invention in detail, it is to be understood that the invention is not limited in its application to the details of construction and arrangement of parts illustrated in the accompanying drawings, since the invention is capable of other embodiments and of being practiced or carried out in the various ways. Also, it is to be understood that the phraseology or terminology employed herein is for the purpose of description and not of limitation.

Figure 1:
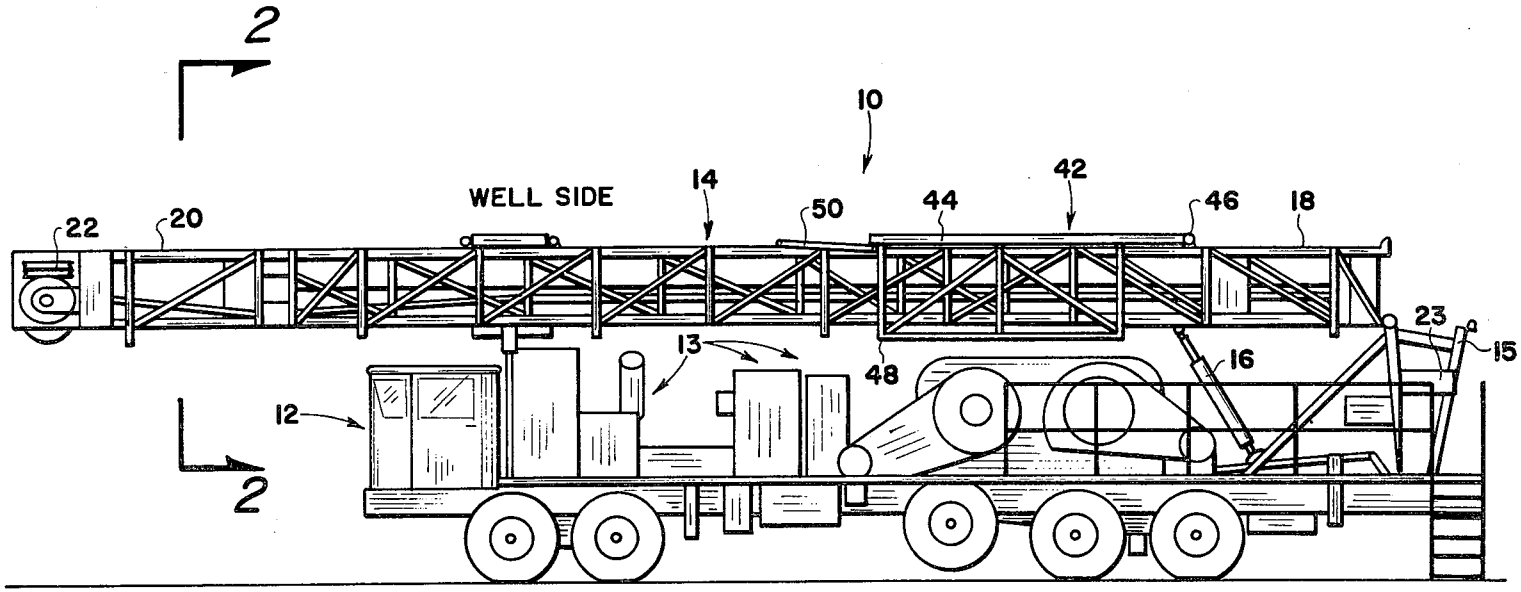
FIG. 1 is a side elevational view of a mobile drilling or well servicing rig mounted to a vehicle with the mast structure embodying the present invention shown in the retracted and horizontal position.

Referring to the drawings in detail, reference character 10 generally indicates the combination of a mobile drilling or well servicing mast structure 14 mounted upon a vehicle 12 having appropriate power driven draw works and other mechanisms 13 used with the mast to not only raise and lower same but to actuate the pulling lines used in the drilling or servicing of the well. The telescoping derrick or mast structure 14, as shown in FIG. 1, is pivotally connected to a rear frame portion 15 of the vehicle 12 to allow for the lowering of the mast structure 14. FIG. 1 shows the mast structure 14 lowered into the horizontal position. Normally these types of structures 10 are used to drill or service moderate depth wells and are moved from location to location over the highway. The first process of the drilling procedure is to back the vehicle 12 up to the drilling or servicing platform (not shown). The mast structure 14 is then raised into the vertical position by a large hydraulic piston 16. Any other suitable means, such as by mechanical or electrical means may be used to raise the mast structure 14. When the mast structure 14 is fully extended, there will be a 3° tilt angle of the mast structure 14 from vertical to allow the mast structure 14 to extend out over the platform or the oil well pumping unit. After extension, the mast structure 14 is maintained in place by guy wires and locking devices (not shown).

Figure 2:
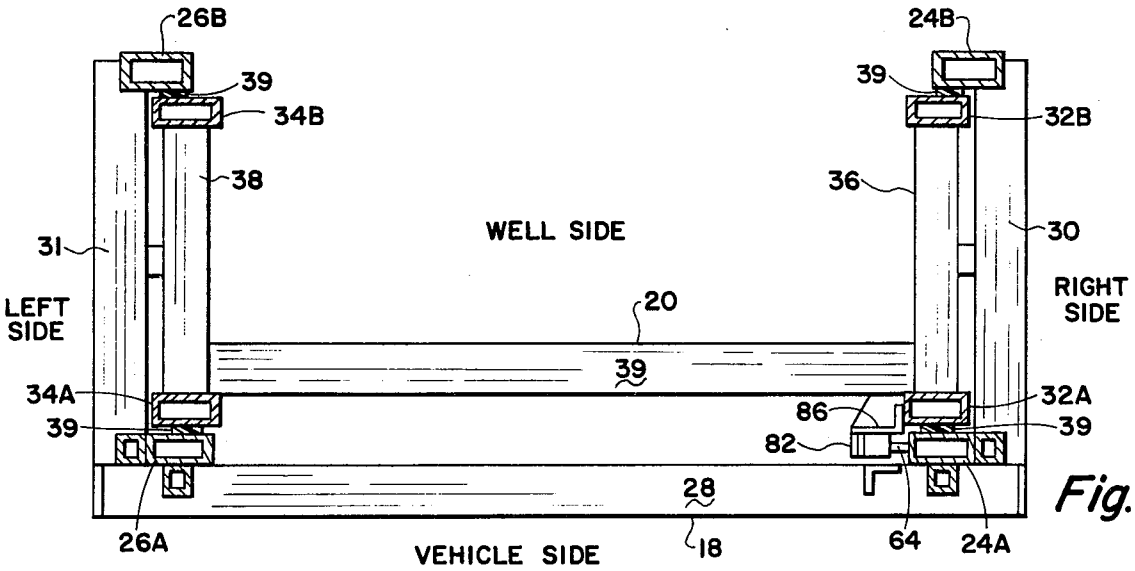
FIG. 2 is a view taken along line 2—2 of FIG. 1.

The mast structure 14 is comprised of at least two telescoping portions with a lower structure 18 pivotally secured to the rear frame portion 15 of the vehicle 12 and an upper structure 20 received within the lower structure 18 and provided with the crown block 22 on the upper end thereof. Both the lower and upper structures 18 and 20 may be of any suitable configuration and construction, however for this discussion the mast structure 14 is of a rectangular configuration having an open face to allow for a central clear area to provide sufficient working room on the well side during the drilling operations. The right side of the vehicle 12 looking toward the well is provided with the drilling operator controls 23. As shown in FIG. 2, the lower structure 18 is a truss comprised of longitudinal (vertical when raised) members 24A and B on the one side of the vehicle 12 and similar longitudinal members 26A and B on the other side. The members 24A and B and 26A and B are connected by a plurality of the transverse horizontal bracings 28 and plurality of spaced horizontal side bracings 30 and 31. Telescopically disposed within the lower structure 18 is the upper structure 20 and is of the same open face rectangular configuration as the lower structure. The upper structure 20 is comprised of a plurality of longitudinal members 32A and B on one side and parallel members 34A and B on the other side. The members 32A and B and 34A and B are connected by a plurality of horizontal side bracings 36 and 38 and transverse bracings 39. The structures 18 and 20 telescope or slide past one another. Between the members 24A and B and 32A and B and between members 26A and B and 34A and B are a plurality of bearing pads 39 to allow for the reciprocal travel of the upper structure 20 within the lower structure 18. The bearing pads 39 may be formed from teflon, polyethylene or any other suitable material which preferably require no lubrication. A hydraulic piston and cylinder (not shown) is attached at one end to the lower structure 18 and at an opposite end to a selected portion of the upper structure 20 and is used to extend and retract the upper structure 20.

On most well mast structures there is a racking platform which extends outward from an upper portion thereof and is used to hold a derrick man and rack strings of drill pipe or tubing during the drilling or servicing operation. This racking platform is usually pivotally connected to the mast for retraction thereof while the drilling rig is moved. In order to operate legally upon the highway the vehicle 12 must be constructed within certain height, width and weight limitations. To aid in the accomplishment of these objectives the present invention provides a novel means to retract and extend a racking platform 42 from the upper mast structure 20 which is both lightweight, simple and does not require a separate power take-off or power source.

Figure 3:
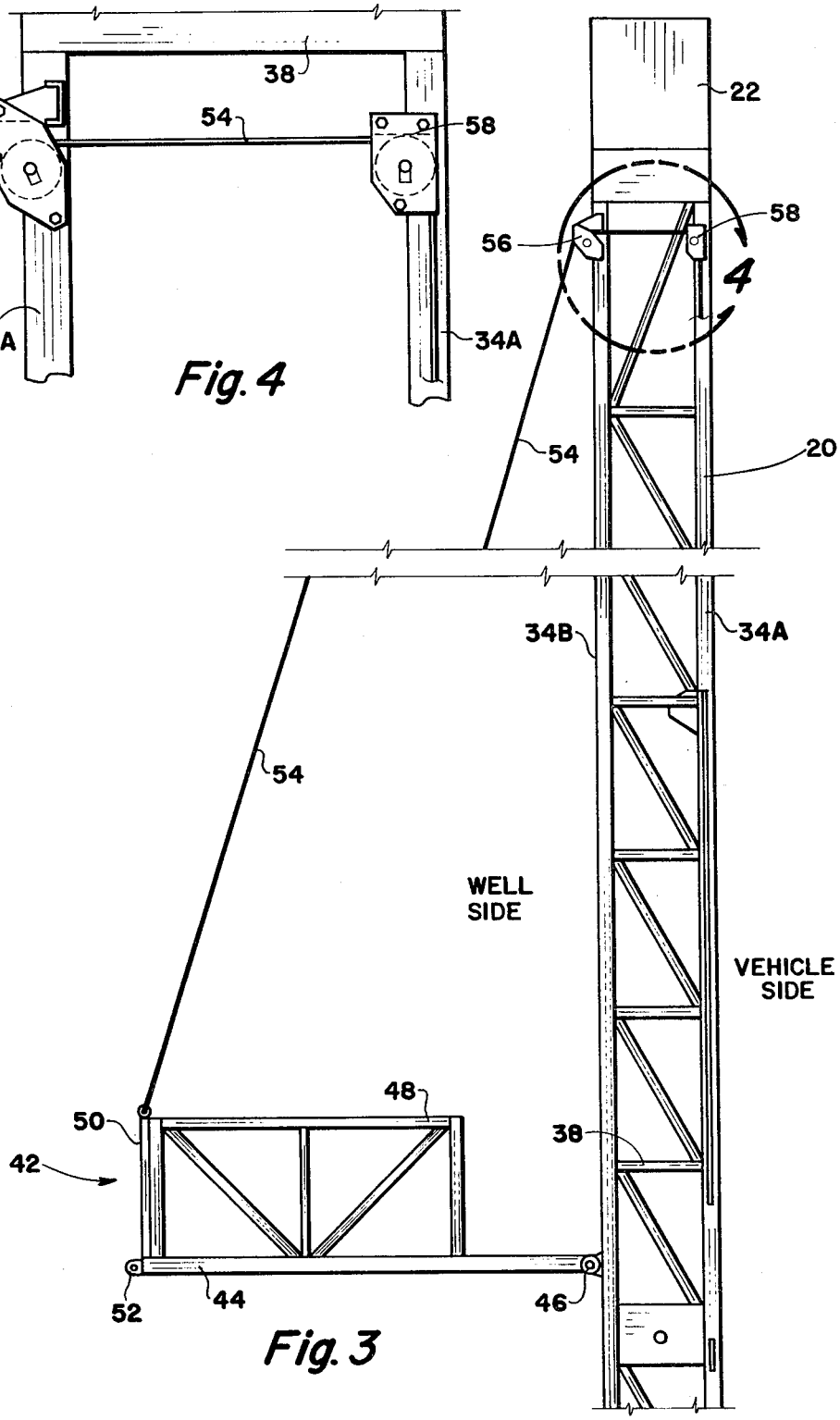
FIG. 3 is a partial side view of the mast structure with a racking platform in the extended position.

As shown in FIG. 3, the racking platform 42 is comprised of a horizontal floor 44 pivotally connected at one end thereof to the members 32B (FIG. 2) and 34B by means of pivotal joint 46 one of which is shown. Two guardrails 48 are attached to either side of the flooring 44 and are of sufficient spaced width to completely straddle the lower structure 18 when the derrick structure 14 is in the travel position, as in FIG. 1. An end guardrail 50 is pivotally secured to an outer end of the flooring 44 by means of pin joints 52 and is designed to rest against the guardrails 48 when the mast structure 14 is extended.

Figure 4:
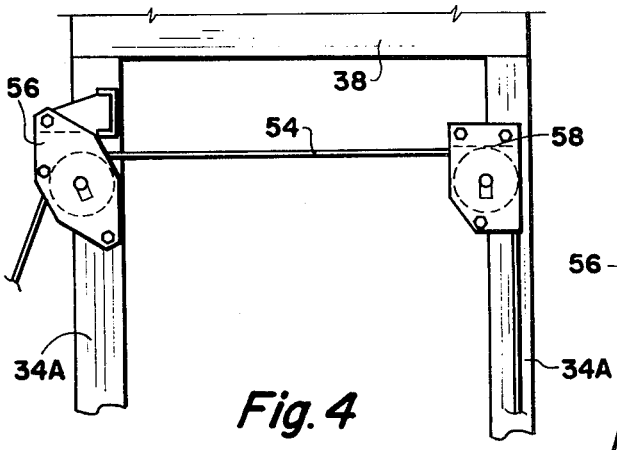
FIG. 4 is a detail view of the pulleys within the upper mast structure.
Figure 5:
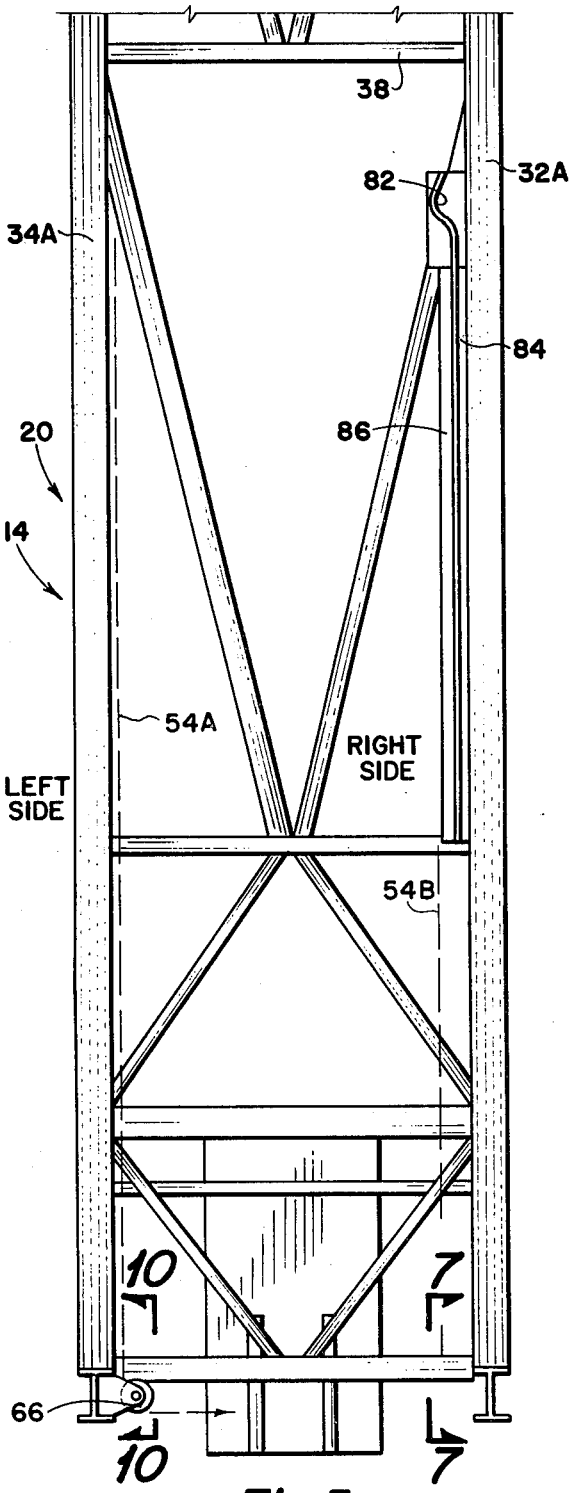
FIG. 5 is a elevational view, from the vehicle side, of a lower portion of the upper mast structure.
Figure 6:
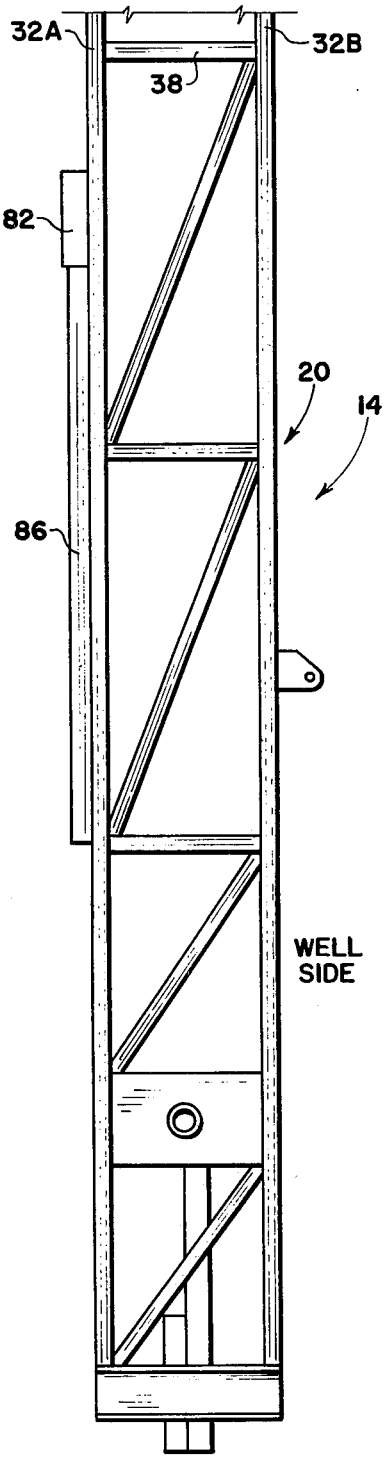
FIG. 6 is a side elevational view of a lower portion of the upper mast structure.
Figure 9:
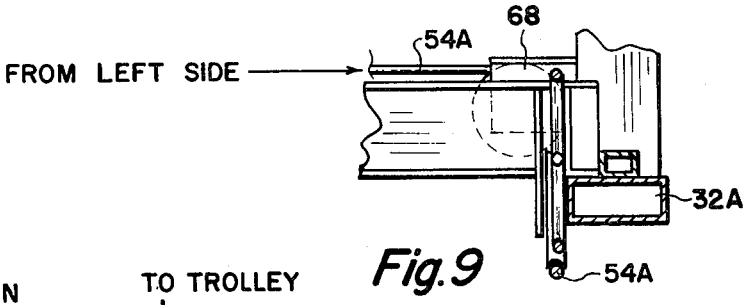
FIG. 9 is a view taken along line 9—9 of FIG. 8.
Figure 7:
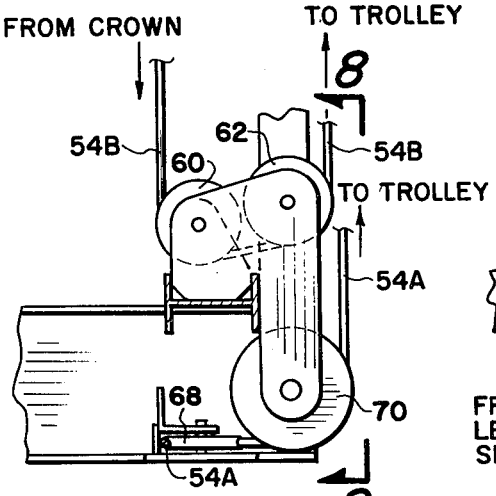
FIG. 7 is a rotated view taken along line 7—7 of FIG. 5 showing the lower pulley arrangement within the operator's side of the upper structure.
Figure 8:
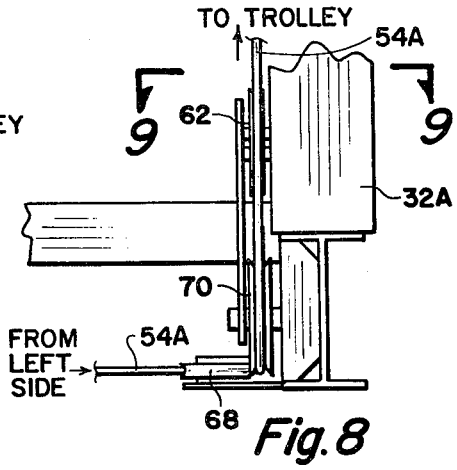
FIG. 8 is a view taken along line 8—8 of FIG. 7.
Figure 10:
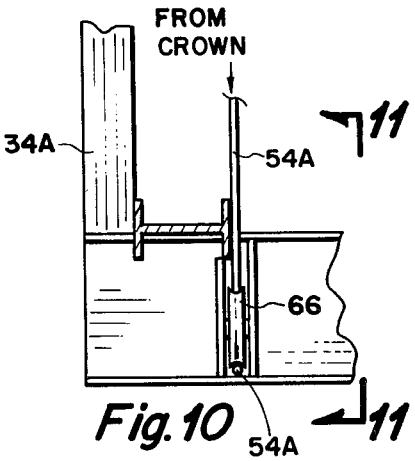
FIG. 10 is a rotated view taken along line 10—10 of FIG. 5 showing the pulley arrangement within the off operator's side of the upper structure.
Figure 11:
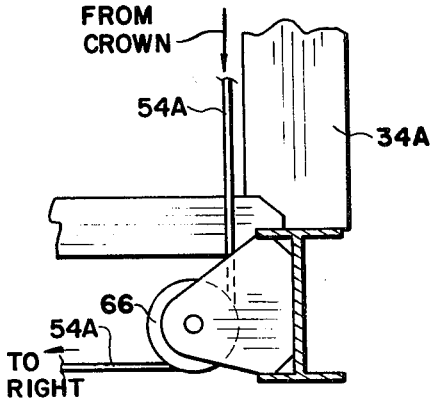
FIG. 11 is a view taken along line 11—11 of FIG. 10.

Extending from each end of guardrail 50 are two parallel cables 54 (only one in view) which pass around two spaced pulleys 56 which are attached to the members 32B and 34B adjacent the crown block 22 and across to two spaced secondary pulleys 58 on the members 32A and 34A as shown in FIG. 4. The cables 54 after passing around the pulleys 56 and 58 extend downward along the sides of the upper structure 20 as shown dotted in FIG. 5 and and designated 54A and 54B. The cable 54B passes downward along the right side thence around a vertical pulley 60 and a second pulley 62, as shown in FIG. 7 in the lower portion of the upper structure 20, thence upward vertically to a wheeled trolley 64, as will be described in more detail in FIG. 12. The cable 54A from the left side extends downward around a vertical pulley 66 attached to a lower portion of the upper structure, as shown in FIGS. 5, 10 and 11, thence across to a horizontal pulley 68 of the right side of the upper structure 20. The cable 54A then goes around a larger diameter vertical pulley 70, as shown in FIGS. 7, 8 and 9, thence vertically upward to the trolley 64. On smaller drilling rigs or if the mechanism herein described is to be used for other purposes, one cable 54 may be all that is required to cause the extension and retraction of the racking platform 42. Utilizing one cable 54 would require only one set of pulleys in the lower portion of the upper structure 20 with all other features remaining unchanged.

Figure 13:
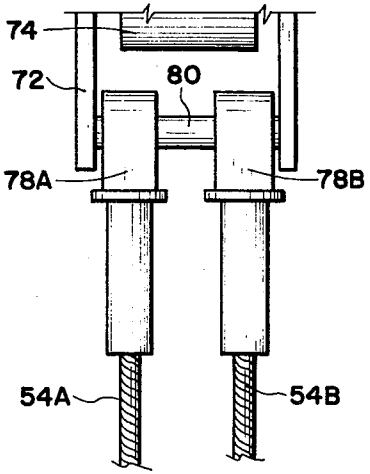
FIG. 13 is a partial view taken along the lines 13—13 of FIG. 12.
Figure 12:
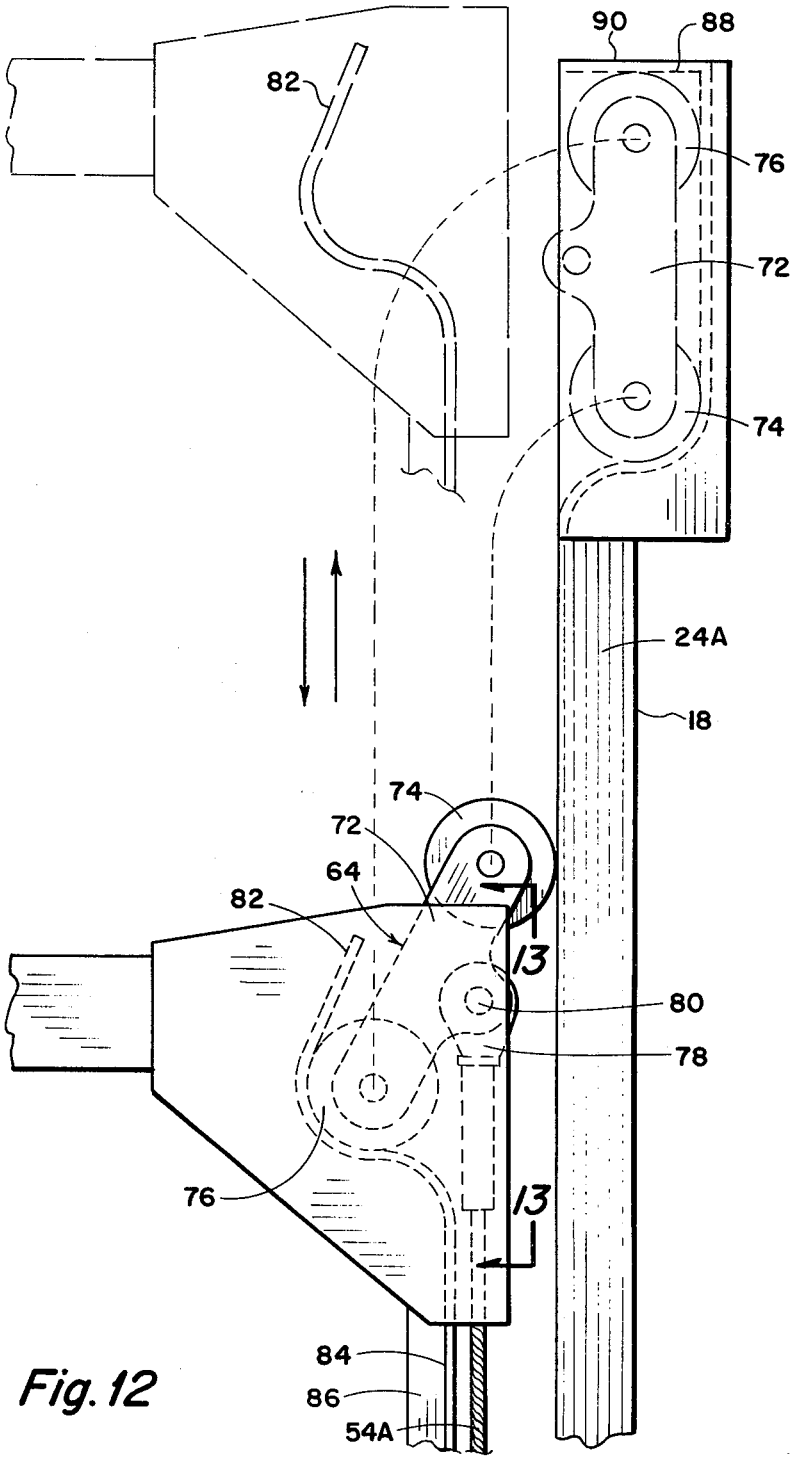
FIG. 12 is a partial view of a trolley being moved by the upper mast along a vertical member of the lower structure.

The trolley 64 is shown in FIGS. 12 and 13 and operates along an inside edge of the member 24A. The trolley 64 is comprised of a central planar link or frame member 72 having two aligned wheels 74 and 76 connected to opposite ends of the frame 72. The cables 54A and 54B are connected to respective wire line sockets 78A and 78B which are pivotally connected to a central portion of the frame 72 by means of a pin 80. FIG. 13 explains the termination of cables 54A and 54B at the trolley. Although, two connectors 78A and 78B are shown other means of connecting the cables may be used. For example, the cables can be spliced together into a single connector. A pushing means or trolley seat 82 cooperable with the trolley 64 is formed from a metal track 84, which is attached to a vertical member 86, which is in turn connected to the vertical member 32A as shown in FIG. 5. Attached to an upper portion of the vertical member 24A of the lower structure 18 is a rectangular open faced trolley housing 88 which is adapted to receive, pivot, and restrain the trolley 64 as will be described below.

In operation, after the mast structure 14 has been raised into the vertical position, the upper structure 20 is caused to slide or extend upwards from the lower structure 18 as for example, by a hydraulic piston and cylinder, not shown. As the upper structure 20 is raised the trolley seat 82 moves the trolley 64 upwards therewith with the wheel 74 riding along an inside edge of the vertical member 24A. As the trolley 64 is moved relative to the lower structure 18 the tension of the cables 54 is maintained due to the relative position of the pulleys 60, 62, 68 and 70 and trolley 64 not changing. The continued tension of the cables 54 maintains the platform 42 in the retracted position. As the trolley 64 is moved into contact with the housing 88 the wheel 74 rotates and drops into the housing 88 causing the trolley 64 to "flip" or rotate about the axis of the pin 80 with the wheel 76 coming to rest against an end panel 90 of the trolley housing 88. As the upper structure 20 continues to be extended the elongated track 84 maintains the trolley 64 locked within the housing 88. The raising of the upper structure 20 relative to the now immobile trolley 64 allows for the reduction of tension upon the cables 54 allowing the racking platform 42 to extend by gravity into the fully extended or horizontal position for use during the drilling operation.

The retraction of the racking platform 42 is accomplished by lowering the upper structure 20 which effectively applies tension to the cables 54 to draw the racking platform 42 upwards into the retraction position with the end guardrail 50 coming to rest against the members 34B and 36B. Once the trolley seat 82 has moved downward past the trolley housing 88 the trolley 64 is pivotally withdrawn from the housing 88 by the tension on the cables 54 and into contact with the trolley seat 82 and rides thereagainst while the upper structure 20 is fully retracted.

What is claimed is:

1. In combination with a telescoping mast having a fixed lower structure and a traveling upper structure, actuation means for timed extension and retraction of a platform attached to said upper structure comprising;

at least one upper pulley secured within said upper structure above said platform;

at least one lower pulley secured within said upper structure below said platform;

traveling means cooperable with said upper structure and said lower structure;

catch means on said lower structure for receiving and retaining said lower traveling means; and cable means extending from said platform around said upper pulley, said lower pulley and connected to said traveling means, whereby when said upper structure is extended said traveling means is propelled along said lower structure until received by said catch means whereupon said platform is extended.

2. Actuation means as in claim 1 wherein said telescoping mast being a well mast.

3. Actuation means as in claim 2 wherein said well mast being mounted to a vehicle.

4. Actuation means as in claim 1 wherein said traveling means moves along a selected portion of a vertical member of said lower structure.

5. Actuation means as in claim 4 wherein said catch means being attached to a top portion of said vertical member of said lower structure.

6. Actuation means as in claim 4 wherein said catch means being a housing for receiving said traveling means.

7. Acuation means as in claim 1 wherein said upper structure is provided with a pushing member cooperable with said traveling means to propel said traveling means along said lower structure.

8. Actuation means as in claim 1 wherein said traveling means being a wheeled trolley.

9. Actuation means as in claim 8 wherein said wheeled trolley comprising a central frame, a plurality of aligned wheels connected to said central frame and connection means in said frame for connection of said cable means.

10. Actuation means as in claim 1 wherein said traveling means pivots upon encountering said catch means and is restrained therein.

11. In a well mast having a fixed lower structure and a telescoping upper structure, the structures having a rectangular cross-section with said upper structure disposed within and slidably engagable with said lower structure, an improved actuation means for timed extension and retraction of a platform pivotally connected to said upper structure comprising:

a plurality of parallel pulleys secured parallel with said platform within an upper portion of said upper structure;

a plurality of pulleys secured within a lower portion of said upper structure below said platform;

traveling means adapted to move along a selected portion of a vertical member of said lower structure;

push means on said upper structure to propel said traveling means along said lower structure;

catch means attached to an upper portion of said vertical member of said lower structure for receiving and retaining said traveling means; and a plurality of cables extending from said platform around said upper and lower pulleys and pivotally connected to said traveling means, whereby when said upper structure is extended said push means moves said traveling means into contact with said catch means and the continued extension of the upper structure allows the platform to extend by gravity.

12. Actuation means as in claim 11 wherein said well mast being mounted to a vehicle.

13. Actuation means as in claim 11 wherein said traveling means being a wheeled trolley comprising a central frame, a plurality of aligned wheels connected to said frame and connection means on said frame for pivotal connection of said cable means, one of said wheels of said trolley being in contact with said vertical member of said lower structure.

14. Actuation means as in claim 13 wherein said trolley rotates about the central axis of said frame upon encountering said catch means and is retained therein.

15. Actuation means as in claim 11 wherein said push means being a curved brace extending from said upper structure.

16. Actuation means as in claim 11 wherein said catch means being a housing attached to the upper end of said vertical member of said lower structure.

* * * * *